United States Patent [19]

MacFee

[11] 4,019,240

[45] Apr. 26, 1977

[54] PROCESS FOR GAPPING SLIDE FASTENER CHAIN

[75] Inventor: Norman W. MacFee, Conneaut Lake, Pa.

[73] Assignee: Textron, Inc., Providence, R.I.

[22] Filed: May 28, 1975

[21] Appl. No.: 581,658

[52] U.S. Cl. ..... 29/408; 29/770; 29/427

[51] Int. Cl.[2] ..... B21D 53/50; B29D 5/00

[58] Field of Search ..... 29/408, 410, 426, 427, 29/207.5 R, 207.5 D, 200 D

[56] References Cited

UNITED STATES PATENTS

| | | | |
|---|---|---|---|
| 3,273,229 | 9/1966 | Taylor | 29/408 X |
| 3,391,441 | 7/1968 | Carlile | 29/408 |
| 3,570,104 | 3/1971 | Jensen | 29/207.5 R X |
| 3,763,546 | 10/1973 | Perlman | 29/408 |
| 3,812,573 | 5/1974 | Fukuroi | 29/427 |
| 3,852,869 | 12/1974 | Shimai | 29/408 |

*Primary Examiner*—Victor A. DiPalma

[57] ABSTRACT

In gapping a stringer of a slide fastener, a plurality of interlocking elements in a portion to be gapped are gripped, such as by a comb, while the tape is clamped or held, and then relative movement is produced between the gripped fastening elements and the held tape either by moving the gripped elements or the held tape with a pivoted motion to pull the gripped elements seriatim from the tape.

7 Claims, 14 Drawing Figures

264b
264
278
PRED. COUNTER
266
COUNTER
286
288
32
276b
218
194
282
284
282a
276a
110
282b
226
280
284a
224
276
274
275
220
260c
222
272
278a
72
260
260a
CLUTCH
238e
270
268
266a
264a
260b
258
262
252
256
254
250
246
248
238
240a
245
238d
244
238a
240
234
236
242
M
238b
238c

PROCESS FOR GAPPING SLIDE FASTENER CHAIN

BACKGROUND OF THE INVENTION

1. Field of the Invention

The invention relates to gapping slide fastener chain, i.e., the removal of a number of fastener elements such as molded plastic fastener elements from the edges of tapes in selected sections of the chain.

2. Description of the Prior Art

The prior art, exemplified in U.S. Pat. Nos. 2,877,844, 3,128,543, 3,225,430, 3,368,269 3,541,666, 3,685,130, 3,763,546, 3,812,754, contains a number of different processes and apparatus for gappinng slide fastener chain having various types of fastening elements. However, the prior art has failed to develop a consistent and reliable method and apparatus for gapping chain having fastening elements of the continuous molded plastic scoop type.

SUMMARY OF THE INVENTION

The invention is summarized in that a process of gapping a slide fastener stringer having a continuous row of fastener elements secured to a edge of the tape of the stringer includes the steps of clamping the tape on the opposite sides of the portion of the stringer to be gapped, and pulling a plurality of the fastener elements in the portion to be gapped relative to the tape seriatim.

An object of the invention is to provide a method and apparatus for removing fastening elements of the plastic molded scoop type from the edge of a selected portion of a tape on which the fastener elements are secured.

Another object of the invention is to remove a plurality of fastener elements from the edge of a tape without damaging the tape and with a minimum amount of force.

It is also an object of the invention to remove a plurality of fastener elements from the edge of a tape one at a time.

One feature of the invention is the provision of a pivotal motion for pulling a plurality of fastening scoops from the edge of a tape such that the scoops are removed serially.

Other objects, advantages and features of the invention will become apparent from the following description of the preferred embodiments taken in conjunction with the accompanying drawings.

DESCRIPTION OF THE PREFERRED EMBODIMENTS

Figure 1A:
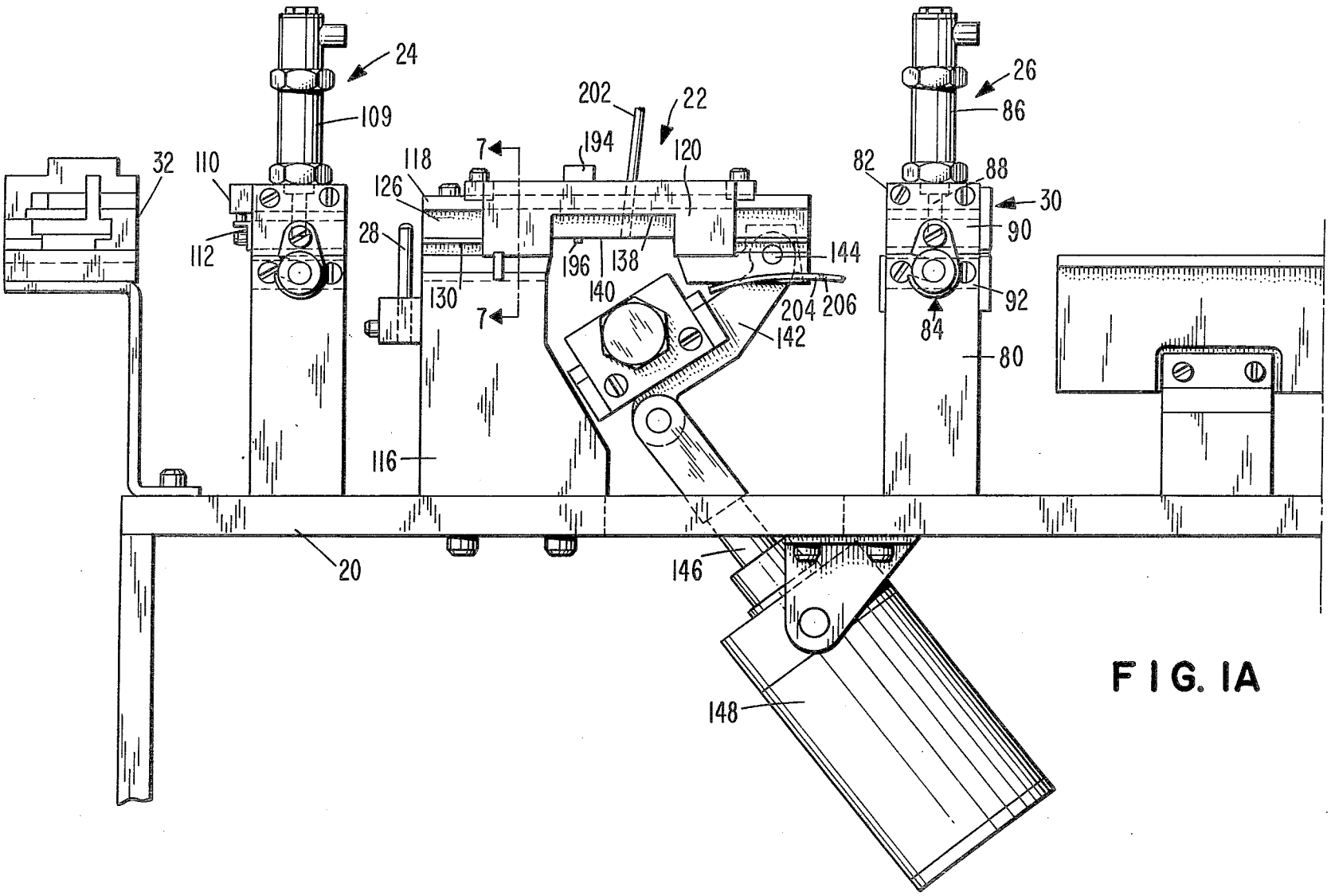
FIG. 1A is a front view of a left portion of an apparatus for gapping a slide fastener chain in accordance with the invention.
Figure 1B:
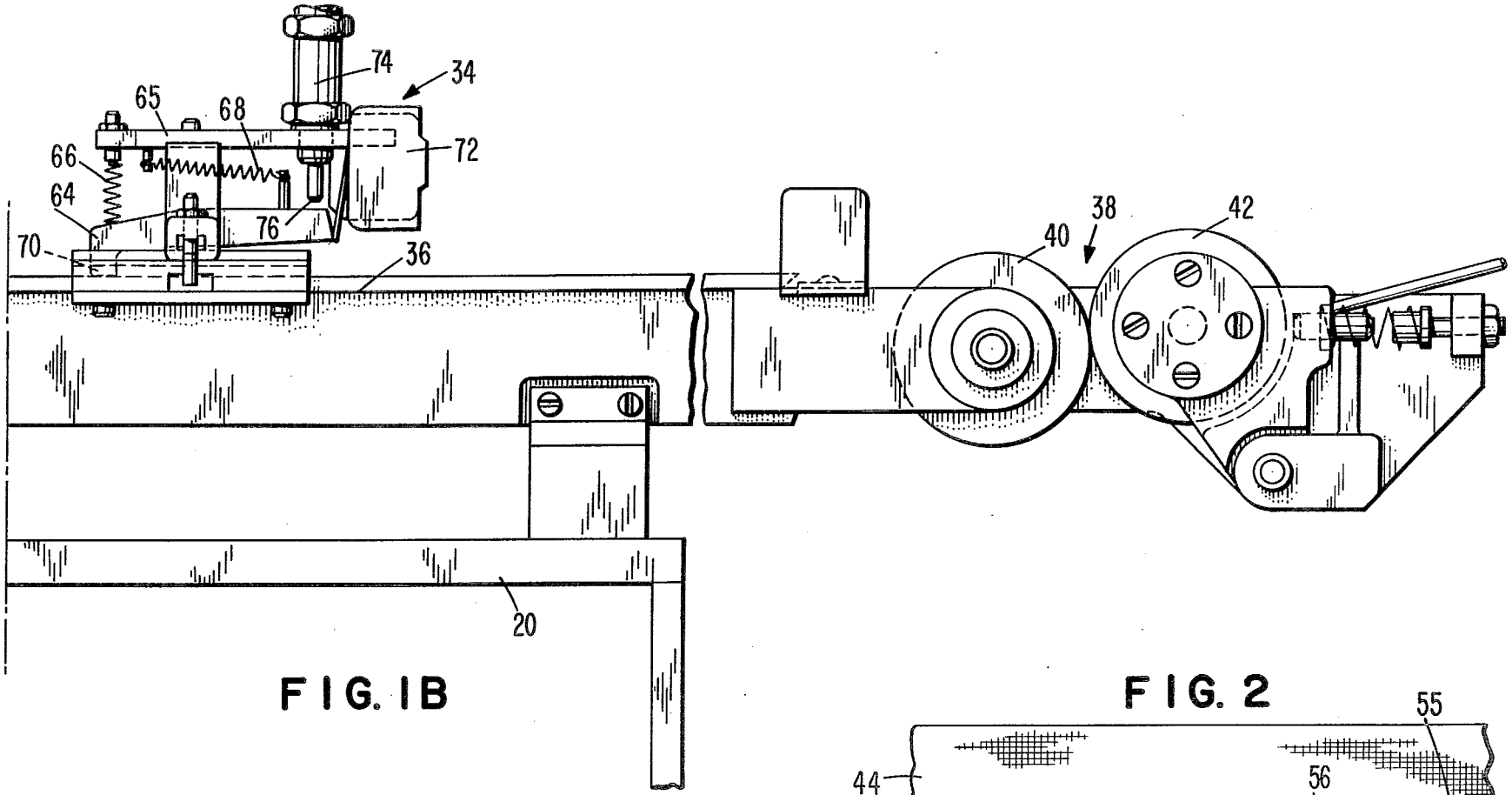
FIG. 1B is a front view of the right portion of the apparatus for gapping slide fastener chain in accordance with the invention.

As illustrated in FIGS. 1A and 1B the invention is embodied and can be practiced in an apparatus for gapping slide fastener chain including a table 20 upon which is mounted a fastening element gripping and pulling mechanism indicated generally at 22, and a pair of tape clamping devices indicated generally at 24 and 26 on respective sides of the mechanism 22. A fastener chain splitter 28 is mounted on the entrance side of the fastener element gripping and removing mechanism 22 while a fastener chain pull up device 30 is mounted on the exit end of the clamping device 26. A conventional fastener chain splice detector 32 is mounted on the table 20 to the entrance side of the clamp 24. A fastener chain gap detecting device indicated generally at 34 is secured by suitable means at a selected point on a rail 36 mounted on the table 20 and extending from a exit side of the clamp device 26 and pull up device 30. A chain pulling mechanism indicated generally at 38 such as a pair of motor driven wheels 40 and 42 is mounted on the far end of the rail 36 from the table 20.

Figure 2:
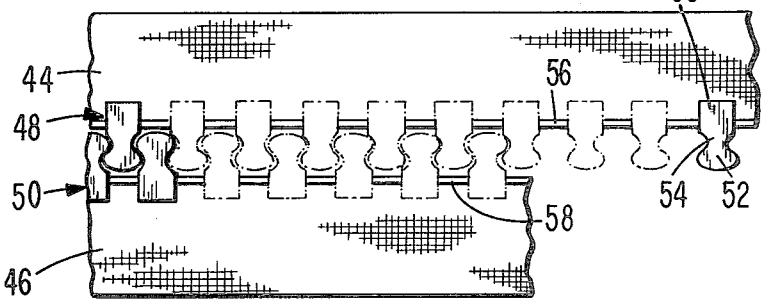
FIG. 2 is a plan view of one type of slide fastener chain suitable for gapping by the apparatus of FIGS. 1A and 1B.

As shown in FIG. 2 a continuous fastener chain to be gapped by the apparatus includes a pair of tapes 44 and 46 with respective rows of fastening elements or scoops indicated generally at 48 and 50 mounted on the inward facing edges of the tapes. The scoops 48 and 50 are formed of molded plastic and have interlocking enlarged heads 52 extending from reduced neck portions 54 and heel portions 55. The tape 44 and the fastening elements 48 form one stringer of the chain while the tape 46 and the fastening elements 50 form the other stringer of the chain. The fastener elements 48 and 50 shown in phantom are to be removed from the inward facing edges of the tapes 44 and 46 to form a gap or section of the chain which has a absence of fastener elements. The tapes 44 and 46 may have respective beaded edges 56 and 58 for more securely supporting the fastener elements 48 and 50.

The fastener chain gap sensing device 34, as shown in FIG. 1B has a lever 64 pivotally mounted on a sensing device frame 65 and biased by springs 66 and 68 to urge a tip 70 of the level 64 against the fastener elements of the chain being pulled therethrough such that the lever 64 pivots when a gap is present in the chain beneath the tip 70. A micro switch 72 is suitably mounted on the frame 65 to be operated by movement of the lever 64. An air cylinder 74 mounted on the frame 65 has a piston rod 76 such that when the air cylinder 74 is actuated the lever 64 is pivoted against its spring bias to raise the tip 70 above a slide fastener chain so that it will not be engaged to the fastening elements at the end of the gap.

Figure 4:
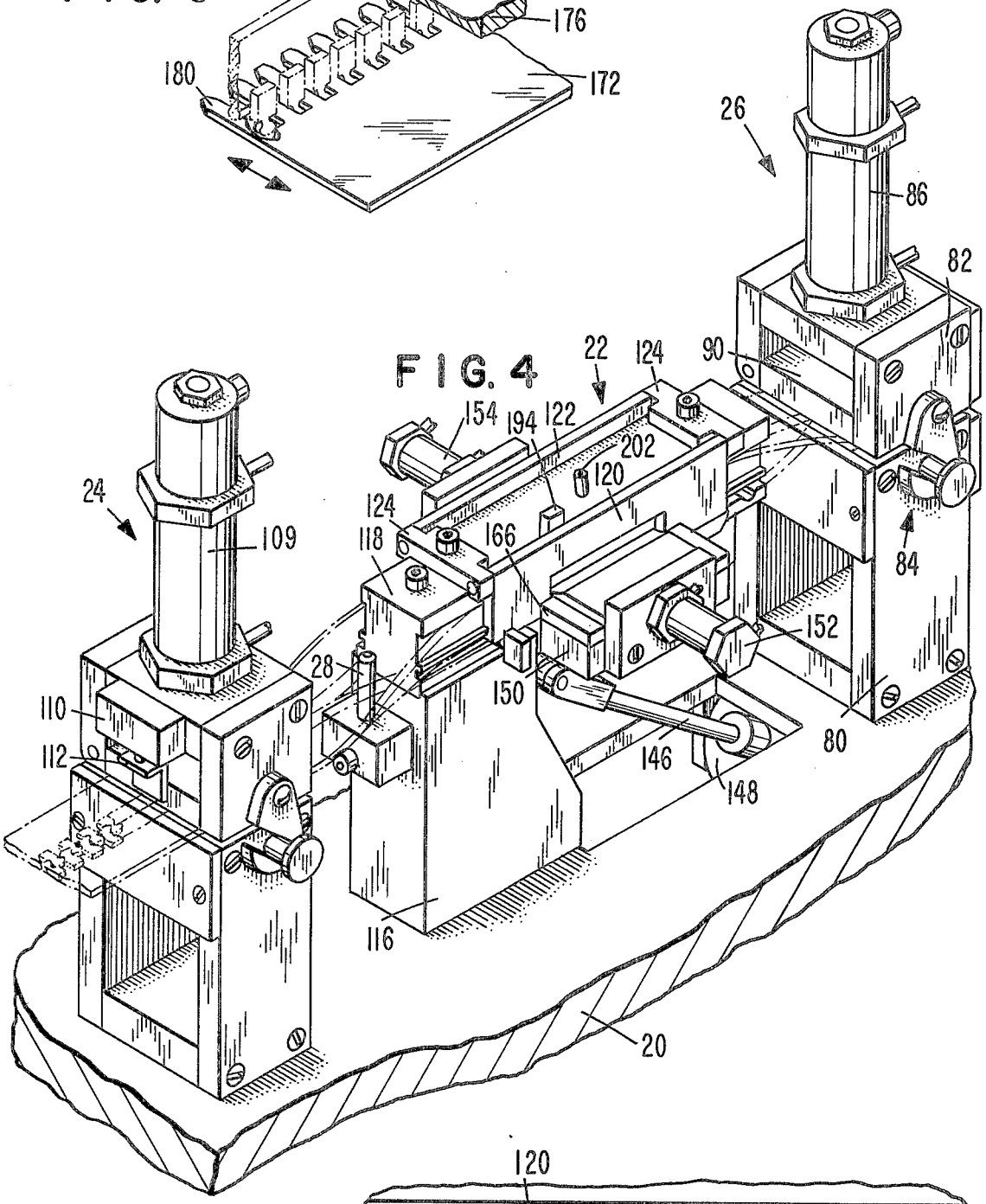
FIG. 4 is a perspective view of a fastener element gripping and removing mechanism broken away from FIGS. 1A and 1B.
Figure 9:
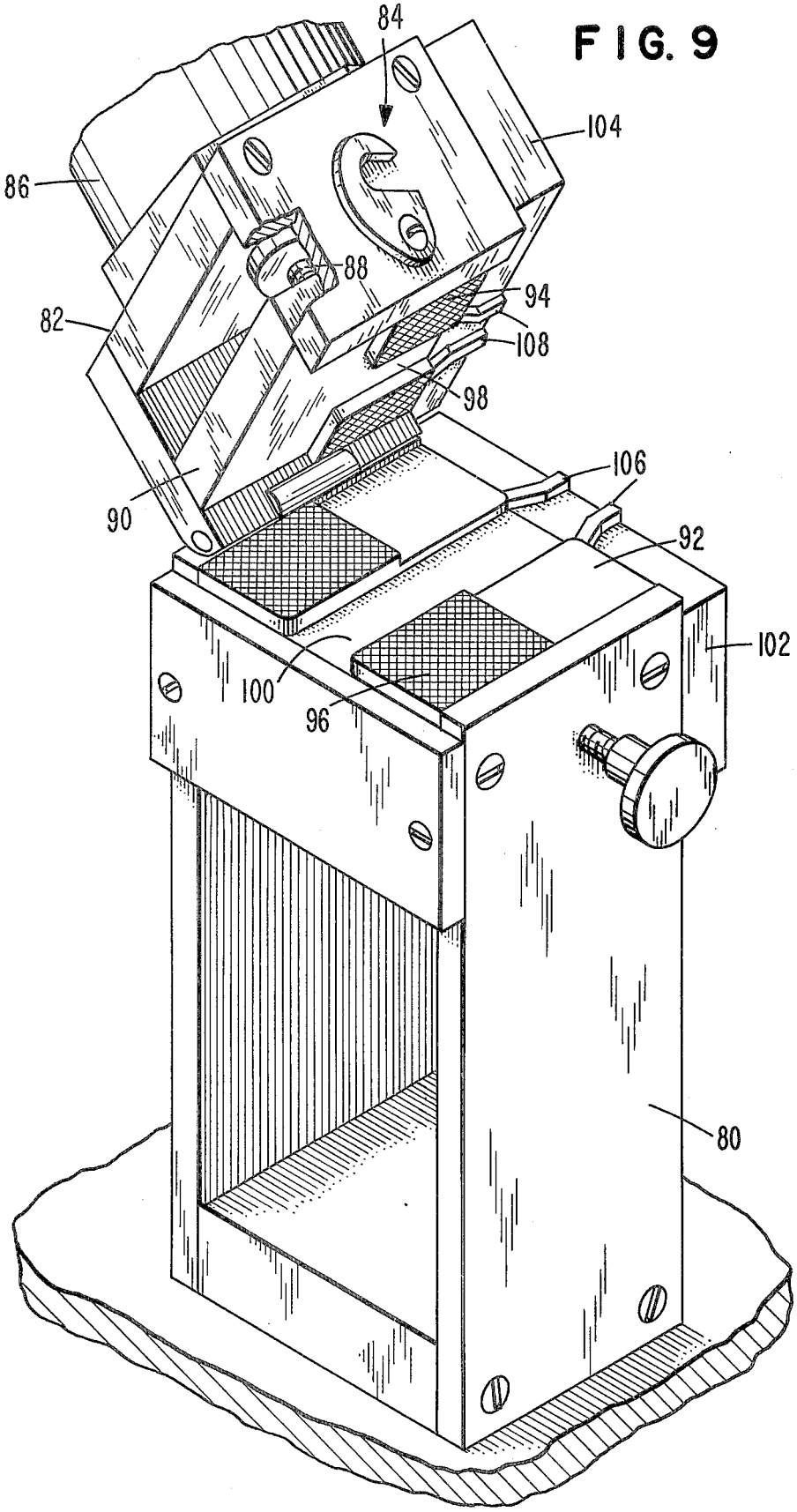
FIG. 9 is a perspective view of a right hand clamp in an open position of the apparatus of FIGS. 1A and 1B.

The clamping device 26 as shown in FIGS. 1A, 4 and 9 includes a support 80 mounted on the table 20 and having an upper hinged portion 82 which is releasably secured by a fastening device indicated generally at 84. An air cylinder 86 is mounted on the upper portion 82 and has a piston rod 88 secured at its end to a movable jaw 90 which cooperates with a stationary jaw 92 mounted on the support 80. The jaws 90 and 92 have respective knurled portions 94 and 96 on respective left and right halves for gripping the tapes of the slide fastener chain. Channels 98 and 100 are formed in the respective jaws 90 and 92 defining a passage for the fastening elements of the slide fastener chain.

The pullup device 30 has lower and upper halves 102 and 104 mounted on the respective lower support 80 and upper portion 82. Flanges 106 and 108 formed in the respective mating edges of the halves 102 and 104 are suitably formed to produce a V-shaped channel designed to pull up or interlock the fastening elements of the slide fastener chain in a conventional manner.

The clamping device 24 is substantially similar to the clamping device 26. A limit switch 110 is suitably mounted on the device 24 to be operated by a projection 112 on the moveable jaw of the device 24.

The fastener element removing and gripping mechanism 22 as illustrated in FIGS. 1A, 4, 6, 7 and 8 has a support block 116 mounted on the table 20 and on which is fixed a split chain guide bar 118. A pair of guide plates 120 and 122 are mounted by hinges 124 on the top of the guide bar 118 to extend in the front and back, respectively, of the guide bar 118. Upper channel portions 126 formed in the front and back of the guide bar 118 together with upper channel portions 128 formed in the back and front of the plates 120 and 122 define a guide passageway for the upper portions of the tapes of the separated stringers of the slide fastener chain. Similarly lower channel portions 130 in the front and back of the guide bar 118 and channel portions 132 in the back and front of the plates 120 and 122 form a guide passageway for the fastener elements of the separated slide fastener stringers. Ribs 131 are left between the channel portions 126 and 130 while ribs 133 are left between the channel portions 128 and 132 to confine the heel portions of the fastener elements to the passageways defined by channel portions 130 and 132. The lower edges of the plates 120 and 122 below the channel portions 132 are securely held against the lower portion of the guide bar 118 by thumb screws 134 and 136 to close the bottom edge of the guide passageways for the stringers. The central portion of the plates 120 and 122 is cut away to form cutouts or openings 130 to expose the fastener elements and at least the lower portion of the tapes of the split stringers of slide fastener chain. Similarly, the central lower portion of the guide bar 118 is cut away at cutout 140 below the upper channel portions 126.

Figure 3:
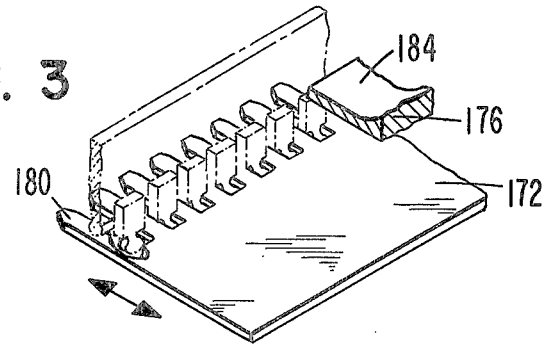
FIG. 3 is a perspective view of a broken away portion of a fastener element gripping mechanism of the apparatus of FIGS. 1A and 1B.

A piviot link 142 is pivotally mounted at one end 144 to the guide bar 118 and at its other end to a piston rod 146 of a air cylinder 148 which is pivotally mounted on the table 20. A pivot plate 150 is suitably fastened to the pivot link 142 and extends to the front and back beneath the cutout 140. Air cylinders 152 and 154 are attached by mounts 156 and 158 on the front and back of the plate 150 and have respective piston rods 160 and 162 freely extending into a channel 164 in the top of the plate 150 and into slots 166 formed in respective fastener element stripping and guide plates 168 and 170 mounted on the side edges of the plate 150. Combs 172 and 174 slidable within a suitable channel formed between stripper plates 168 and 170 and the plate 150, and outer scoop pull down members 176 and 178 are fixed on the extending ends of the piston rods 160 and 162. The combs 170 and 174 are shown in FIG. 3 have a plurality of teeth or fingers 180 designed to fit into the neck portions above the head portions of the fastener elements to firmly grip the fastener elements of the slide fastener stringers. The outer pull down members 176 and 178 have a central mounting portions 182 extending through the slots 166 of the stripping blades 168 and 170 and extend above the stripping blades 168 and 170 to forward edges 184 which are designed to be positioned in engaging relationship above the heel portions of the fastener elements on the outsides of the tapes exposed in the cutouts 138 when the piston rods 160 and 162 are in an advanced position. An anvil member 186 and an inner pull down member 188 are fixed on the plate 150 to extend up into the cutout 140 of the guide bar 118 when the pivot plate 150 is in a raised position. The anvil 186 has slots 190 aligned with the combs 172 and 174 for receiving the extending ends of the fingers 180 of the combs 170 and 174. The front and back edges of the inner pull down member 188 protrude toward the forward edges 184 of the outer pull down members 176 and 178 to form a mating inside heel portion engaging pull off for the fastener elements on the stringers of the slide fastener chain.

A limit switch 194, FIG. 1A, is mounted on the guide bar 118 and has a operating element 196 for being operated when the pivot link 142 and pilot plate 150 are in a raised position. A blow off line 202 extends to a suitable vertical opening in the guide bar 118 and blow off lines 204 and 206 extend to the respective front back of the pivot link 142 for blowing fastener elements off the fastener element strippers 168 and 170 and the inner pull down member 188.

Figure 10:
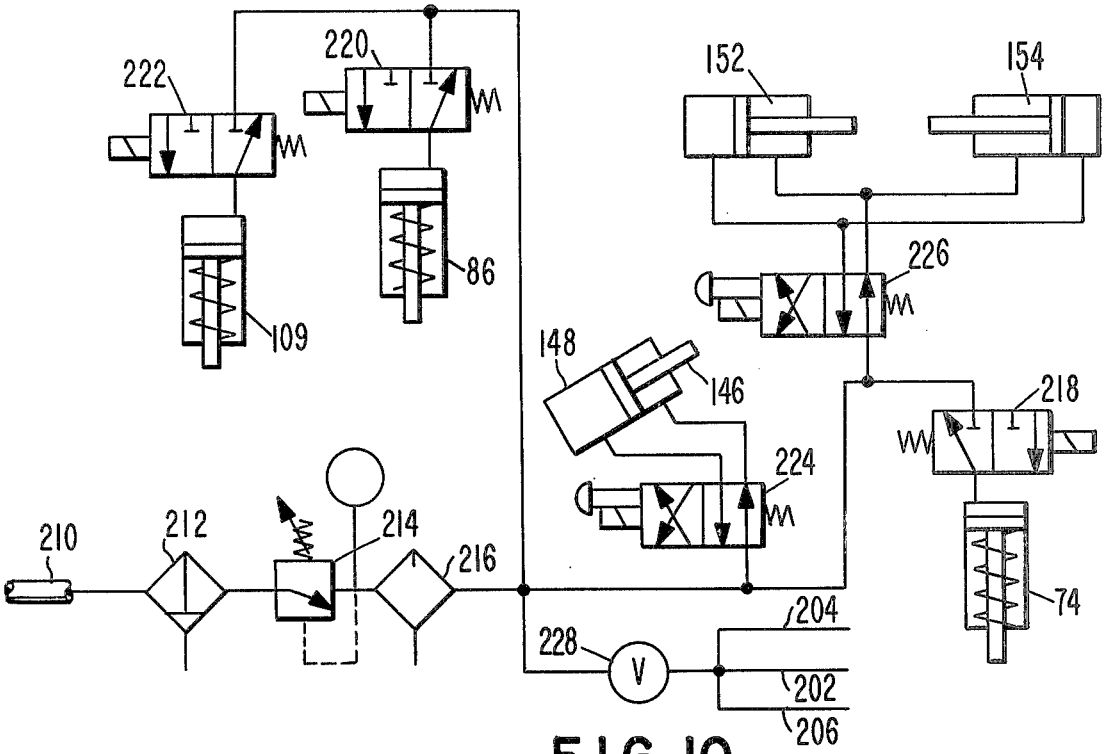
FIG. 10 is a diagram of a pneumatic control arrangement for the apparatus of FIGS. 1A and 1B.

As shown in FIG. 10 an air pressure supply source 210 is connected in series with a filter 212, a pressure regulator 214 and a lubricator 216. The air cylinders 74, 86 and 109, illustrated as spring return air cylinders, have their advance inputs connected to outputs of respective solenoid operated valves 218, 220 and 222 which have their inputs connected to the output of the lubricator 216. The double acting air cylinder 148 has its inputs connected to outputs of a valve 224 which includes a solenoid and a push button for operating the valve 224. The inputs of the air cylinders 152 and 154 are connected to the outputs of a valve 226 which is similar of the valve 224 and has its input connected to the output of the lubricator 216. A manual valve 228 joins the blow off lines 202, 204 and 206 to the air pressure supply.

Figure 11:
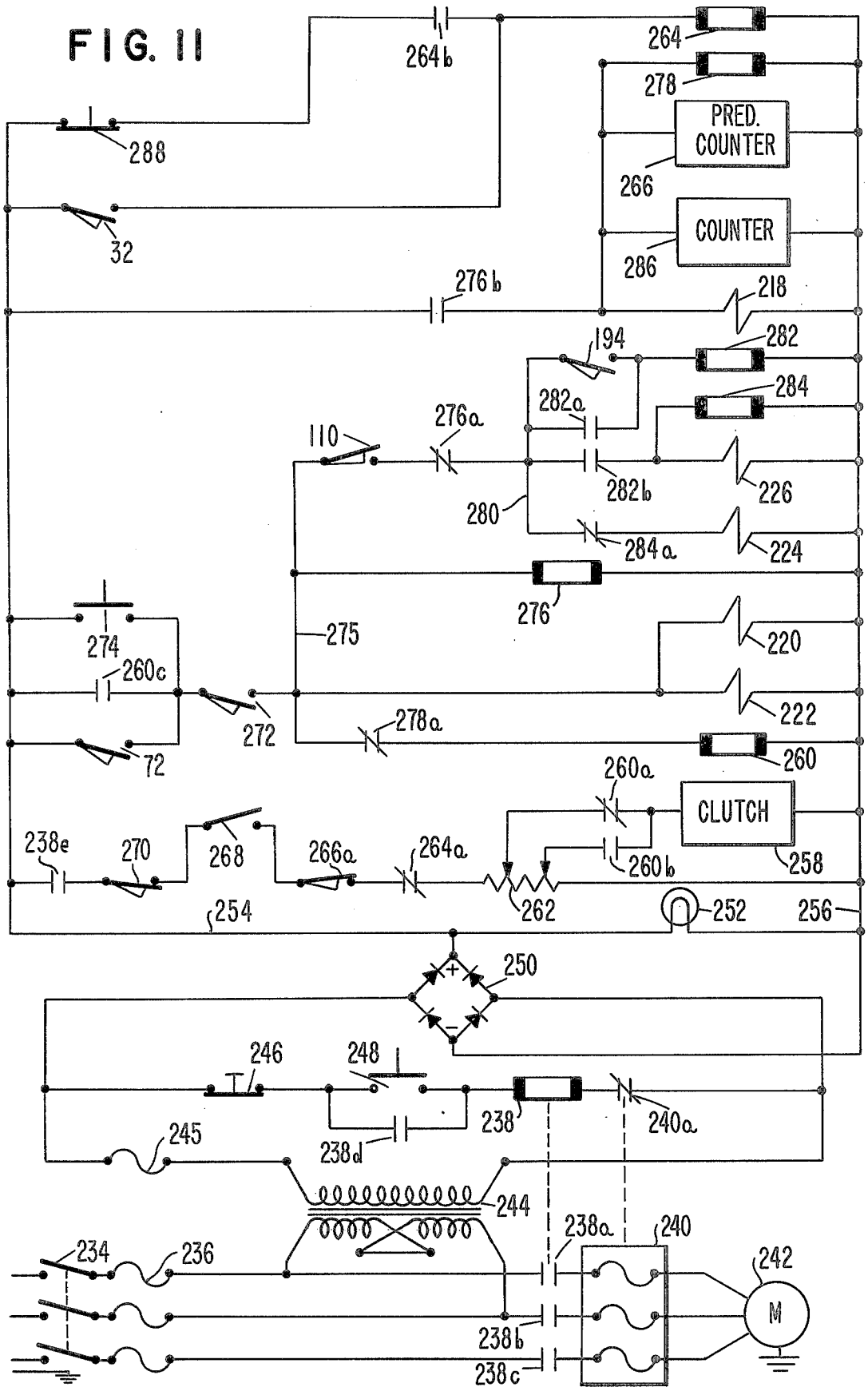
FIG. 11 is a diagram of an electrical control circuit for the apparatus of FIGS. 1A and 1B.

In the electrical control circuit, shown in FIG. 11, input lines from a suitable A.C. power source are connected by a disconnect switch 234, fuses 236, contacts 238*a*, 238*b* and 238*c* of a relay 238, and an overload protection device 240 to inputs of a puller motor 242. The primary winding of a step down transformer 244 is connected across two of the input lines while a secondary of the transformer former 244 is connected in series with a fuse 245, a normally closed push bottom stop switch 246, a normally open push button START switch 248, the winding of the relay 238, and normally closed contacts 240*a* of the overload protection device 240. Normally open contacts 238*d* of the relay 238 are connected across the switch 248. AC power inputs of a full way bridge rectifier 250 are connected in series with the fuse 245 and the secondary winding of the transformer 244.

A POWER ON indicator lamp 252 is connected across the direct current outputs of the bridge rectifier 250 on respective lines 254 and 256. A solenoid operated clutch, such as a magnetic particle clutch 258, is connected in a first series circuit from the line 256 through normally closed contacts 260*a* of a relay 260 to a first adjustable tap on a resistance 262, and in a second series circuit from the line 256 with normally open contacts 260*b* of the relay 260 to a second adjustable lap of the resistance 262. The resistance 262 is connected in a series circuit with normally closed contacts 264*a* of a relay 264, normally closed contacts 266*a* of a predetermining counter 266, a manual switch 268, a guard switch 270, and normally open contacts 238*e* of the relay 238. The clutch 258 connects the motor 242 to the fastener chain advancing wheels 40 and 42, FIG. 1, in a conventional manner. A main guard normally open protective switch 272 is connected between a junction 275 and a parallel arrangement of a normally open jog push button switch 274, normally open contacts 260*c* of the relay 260, and the normally open contacts of the gap detector switch 72 connected to the line 254. The switches 270 and 272 are suitable interlock switches which are closed when suitable shields or guards (not shown) are in place. The windings of the solenoid valves 220 and 222 and a timer delay relay 272 are connected in parallel between the junction 275, and the line 256. The winding of the relay 260 is connected in series with normally closed contacts 278*a* of a relay 278 between the junction 275 and the line 256. The limit switch 110 is connected between the junction 275 and in series with normally closed contacts 276*a* of the time delay relay 276 to a junction 280. A parallel arrangement of the limit switch 194, and normally open contacts 282*a* of a relay 282 are connected in series with the winding of the relay 282 across the junction 280 and the line 256. Normally open contacts 282*b* of the relay 282 are connected in series with a parallel arrangement of the winding of the solenoid valve 226 and a time delay relay 284 between the junction 280 and the line 256. Normally closed contacts 284*a* of the time delay relay 284 are connected in series with the winding of the solenoid valve 224 across the junction 280 and the line 256. Normally open contacts 276*b* of the time delay relay 276 are connected in series with the parallel arrangement of the winding of the relay 278, the predetermining counter 266, a totalizing counter 286 and the winding of the solenoid valve 218. The winding of the relay 264 is connected in a first series circuit with normally open contacts of the splice detector 32 across the lines 254 and 256 and a second series circuit with normally open contacts 264*b* of the relay 264 and a manual reset switch 288 across the lines 254 and 256.

In operation of the apparatus for gapping a slide fastener stringer and the practice of the process thereof, the slide fastener stringer is positioned within the fastener element gripping and removing mechanism 22 with portions of the slide fastener chain extending from the opposite sides of the mechanism 22 into the clamping devices 24 and 26. The clamping devices 24 and 26 are operated to securely hold the slide fastener chain while the fastener element gripping and removing mechanism 22 is operated to remove a plurality of fastener elements 48 and 50 seriatim from respective selected sections of the slide fastener tapes 44 and 46. The plurality of the fastener elements 48 and 50 in the selected sections of the stringers to be gapped are gripped and each of the gripped pluralities of fastener elements 48 and 50 are pulled from the edges of the tapes 44 and 46 to which they are secured.

Figure 5:
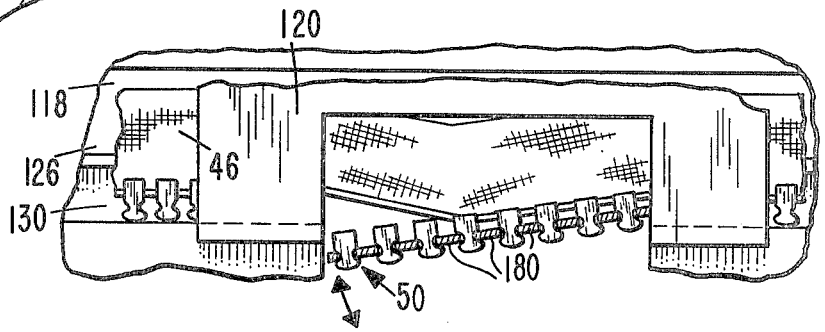
FIG. 5 is a front view of a broken away portion of the mechanism shown in FIG. 4.
Figures 6, 7, 8:
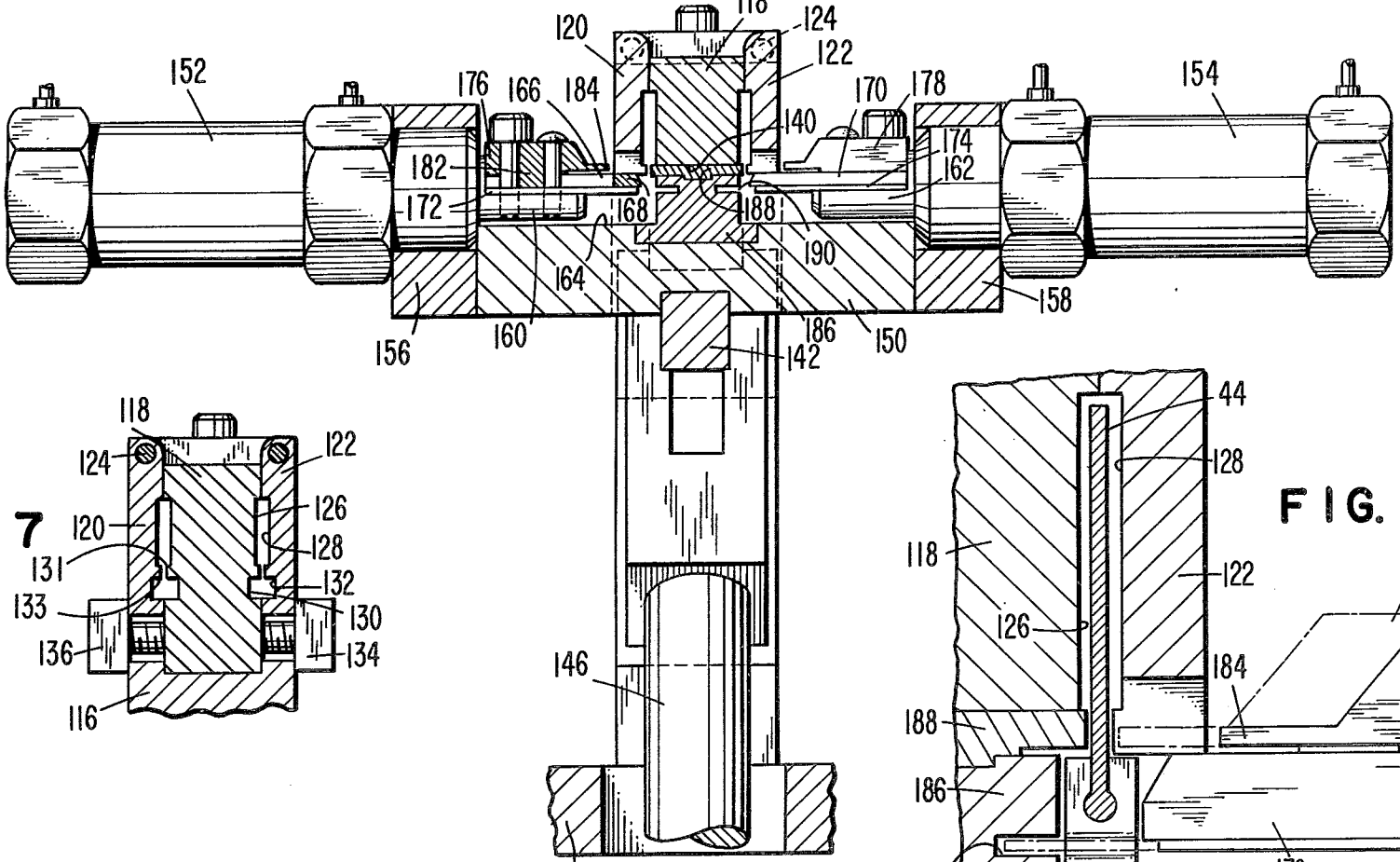
FIG. 6 is a side cross section view of the mechanism of FIG. 4.
FIG. 7 is a side cross section view taken along line 7—7 of FIG. 1A.
FIG. 8 is an enlarged view of a broken away portion of the mechanism shown in FIG. 6.

More particularly as shown in FIG. 5 the gripping and removing mechanism simultaneously grips each of the selected plurality of fastening elements 48 and 50 to be removed and imparts a pivotal downward movement to the gripped fastening elements 48 and 50 which results in each fastening element of the gripped pluralities of fastener elements 48 and 50 being pulled one at at time from the respective tapes 44 and 46. The fastening elements 48 and 50 are gripped by the insertion of the fingers 180 between the neck portions 54 of the fastener elements to engage the head portions 52 and pull the fastener elements 48 and 50 in a pivotal movement relative to the tapes 44 and 46.

The fastening devices 84 of each of the clamping devices 24 and 26 when released allow the top portions 82 to be opened. The thumb screws 134 and 136 of the fastener element gripping and removing mechanism 22 when opened allow the plates 120 and 122 to be pivoted upward away from the guide bar 118. The slide fastener chain is inserted into the splice detecting mechanism 32 in a conventional manner and over the stationary jaws 92 of the clamping devices 24. Between the clamping devices 24 and 26 the slide fastener chain is split open and the separated stringers are positioned on opposite sides of the chain splitter 28 and the guide bar 118 with the fastening elements in the channels 130 and tapes extending upward into the channels 126. The plates 120 and 122 are pivoted against the front and back of the guide bar 118 and secured in place by the thumb screws 134 and 136. The top portions 82 of the clamping devices 24 and 26 are pivoted closed and secured by the clamping devices 84 with the fastener chain extending between the upper and lower halves of the pullup device 30 such that the fastener elements pass through the channel between flanges 106 and 108, FIG. 9.

The end of the slide fastener chain extending from the clamping device 26 is suitably threaded through the gap detecting device 34 and the chain pulling mechanism 38. The gap detecting mechanism 34 is set at a selected distance on the rail 36 from the fastener element gripping and removing mechanism 22 to produce a predetermined distance or length of chain between successive gaps in the slide fastener chain.

Referring to FIG. 11 the electrical circuit controlling the operation of the gapping apparatus is energized by closing the switches 234. The apparatus can be set for manual or automatic operation by the switch 268, the manual operation being the switch 268 in its open position while the automatic position being the switch 268 in the closed position. In the manual mode the clutch 258 is de-energized and the slide fastener chain must be manually pulled through the gap detector 34, clamping device 36, the fastener element gripping and removing mechanism 22, and the clamping device 24 bypassing the automatic pull up mechanism 38. In the automatic mode the clutch 258 is energized to connect the puller motor 242 to the puller wheels 40 and 42 and thus the slide fastener chain can be automatically pulled through the gapping apparatus.

A first gap can be placed in the slide fastener chain by depressing the jog push button switch 274 which energizes the solenoid valves 220 and 222 and the relay 260 which closes contacts 260*c* to maintain the circuit from line 254 to the junction 275. The operation of the solenoid valves 220 and 222, FIG. 10, operates the air cylinders 86 and 109 to lower the moveable jaws 90 in the clamping devices 24 and 26 to securely grip the tapes 44 and 46 of the slide fastener chain on opposite sides of the fastener element gripping and removing mechanism 22. When the movable jaw 90 of the clamping device 24 closes the limit switch 110 is closed which in turn energizes the solenoid valve 224 operating the air cylinder 148 to pivot the pivot link 142 upward moving the pivot plate 150, the anvil 186 and the inner pull down member 188 to their positions illustrated in FIGS. 4 and 6. In this raised position, the limit switch 194 is closed which energizes the relay 282 completing a circuit through the contacts 282*a* to hold the relay 282 energized. Also the contacts 282*b* are closed energizing the solenoid valve 226 to operate the air cylinders 152 and 154 which advance the piston rods 160 and 162 to insert the fingers 180 of the combs 172 and 174 between the neck portions of the fastening elements and to move the forward ends 184 of the outer pull down member 176 and 178 above the heel portions of the fastener elements. The closing of the relay contacts 282*b* also energizes the time delay relay 284 which operates after the advancement of the piston rods 160 and 162 to open contacts 284*a* thus de-energizing the solenoid valve 224. The de-energizing of the solenoid valve 224 causes the retraction of the piston rod 146 of the air cylinder 148 to pivot the pivot link 142 together with the pivot plate 150, and the anvil 186, the inner pull down member 188, the combs 172 and 174, and the outer pull down members 176 and 178 downward. It is during this movement that the pluralities of fastener elements on the selected section of tapes are pulled seriatim from the slide fastener tapes. The slots 190 in the anvil hold the extending ends of the fingers 180 from the combs 172 and 174 thus insuring that in fingers 180 are not bent and are better supported during the forces exerted during this pivotal motion. Additionally the stripping or pulling of the fastener elements from the tapes is aided by the engagement of the inner pull down member 188 and the forward portions 184 of the outer pull down members 176 and 178 against the heel portions of the fastening elements.

After the retraction of the piston rod 146, the time delay relay 276, previously energized by the operation of the push button switch 275 and the closing of the relay contact 260*c*, operates to open the contacts 276*a* thus de-energizing the solenoid valve 226 along with the relay 282 and the time delay relay 284. De-energizing the solenoid valve 226 causes the air cylinders 152 and 154 to retract pulling the combs 172 and 174 from the anvil 186 as well as moving the outer pull down members 176 and 178 away from the inner pull down member 188. During the retraction of the piston rods 160 and 162 the removed fastener elements are stripped from the fingers 180 of the combs 172 and 174 by engagement with the forward edge of the stripper plates 168 and 170. The valve 228 is opened to produce air jets through the blow lines 202, 204 206 insuring that the removed fastening elements which have been stripped from the fingers 180 are blown or fall clear from the fastener element gripping and removing mechanism 22.

Pulling of the slide fastener chain gap sensing device 34 until the gap previously formed in the slide fastener chain passes beneath the tip 70 results in the lever 64 pivoting to operate the switch 72 which thus energizes the terminal 275 and the relay 260 to produce another cycle of the clamping devices 224 and 226 and the fastener element gripping and removing mechanism 22 as described above. At the end of that cycle the time delay 276 operates to close contacts 276*b* which energizes the solenoid valve 218 causing the piston rod 76 to pivot the level 64 and raise the tip 70 from the gap in the slide fastener chain. Also the movement of the lever 64 by the piston rod 76 opens the switch 72 to allow de-energization of the terminal 275 and thus ready the gapping apparatus for another advancement of the slide fastener chain.

In the automatic mode of operation the motor 242 is started by depressing switch 248 which energizes the relay 238 closing contacts 238*a*, 238*b* and 238*c* and thus energizing the motor 242. Also contacts 238*d* and 238*e* are closed to complete a holding circuit for the relay 238 and to complete the circuit for the clutch 258. When the relay 260 is de-energized during the interval of the cycle of the fastener element gripping and removing mechanism 22, the clutch 258 is energized with a high voltage through the contacts 260*a* to produce a high torque on the pulling wheels 40 and 42 to pull the slide fastener chain. When the relay 260 is energized during the cycle of the fastener element gripping and removing mechanism 22 the clutch 258 is energized by the low voltage through the contacts 260*b* to apply a low torque to the pulling wheels 40 and 42 to thus render a low tension on the fastener tape between the clamping device 26 and the automatic pulling mechanism 38.

For each operation of the time delay relay 276 the counters 266 and 286 are advanced by the operation of the contacts 276*b*. When counter 266 reaches the predetermined count the contacts 266*a* are opened which de-energizes the clutch 258 thus preventing subsequent pulling of the fastener chain and terminating automatic operation of the gapping apparatus.

In the event a splice in a slide fastener is detected by the splice detector switch 32, the relay 264 is energized completing a holding circuit through contacts 264*b* and opening contacts 264*a* to de-energize the clutch 258 and thus terminate automatic operation of the slide fastener gapping apparatus. The automatic operation of the slide fastener apparatus can be commenced by depressing the reset switch 228 which de-energizes the relay 264 allowing continued operation of the gapping apparatus.

Figure 12:
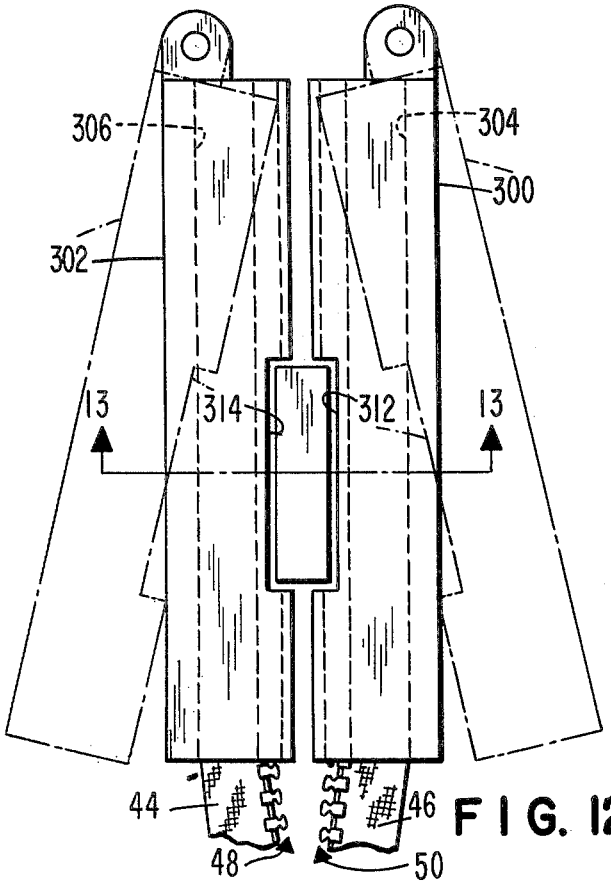
FIG. 12 is a plan view of a modified apparatus for gapping slide fastener in accordance with the invention.
Figure 13:
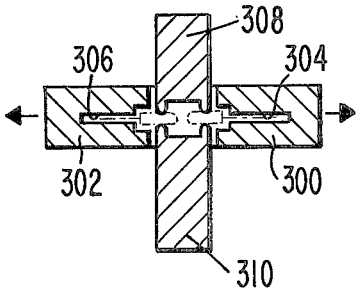
FIG. 13 is a cross section view taken along 13—13 of FIG. 12.

A modificaton of the slide fastener chain gapping apparatus illustrated in FIGS. 12, and 13 utilizes a pair of pivoted slide fastener guide members 300 and 302 which have respective passageways 304 and 306 for receiving and guiding separated stringers of a slide fastener chain with the fastening elements of the stringers facing toward each other. Fastener element gripping members 308 and 310 are moveably positioned above and below respective removed central portions 312 and 314 of the members 300 and 302 exposing the fastening elements. When the fastening element gripping members 308 and 310 are closed as shown in FIG. 13 to grip the fastener elements the guide members 302 are pivoted outward, as shown in phantom, to strip the plurality of fastener elements gripped by the members 308 and 310 seriatim from the respective tapes of the slide fastener chain. The force of gripping members 308 and 310 is such as to partially loosen the fastening elements from the edges of the tapes.

Since many modifications, variations, and changes in detail may be made to the above described embodiments it is intended that all matter contained in the foregoing description and accompanying drawings be interrupted as illustrative and not in a limiting sense.

What is claimed is:

1. A process of gapping a slide fastener stringer having a continuous row of fastening elements secured to an edge of a tape of the stringer comprising the steps of gripping a plurality of fastening elements in a portion of the stringer to be gapped, holding the tape, and producing relative pivotal movement between the gripped plurality of fastening elements and the held tape so as to separate the gripped plurality of fastening elements from the tape seriatim.

2. A process of gapping a slide fastener stringer having a continuous row of fastener elements secured to an edge of a tape of the stringer comprising the steps of clamping the tape on the opposite sides of a portion of the stringer to be gapped, gripping a plurality of fastener elements in the portion to be gapped by a gripping member, and pivoting the gripping member relative to the tape to pull the plurality of fastener elements from the tape seriatim.

3. A process of gapping a slide fastener stringer having a continuous row of fastener elements secured to an edge of a tape of the stringer comprising the steps of clamping the tape, gripping a plurality of fastener elements in a portion of the stringer to be gapped, and moving the gripped plurality of faStener elements relative to the clamped tape with a pivotal movement such that the gripped plurality of fastener elements are removed seriatim from the edge of the tape.

4. A process as claimed in claim 3 wherein the fastener elements have reduced neck portions, the gripping step includes the insertion of the teeth of a comb between the reduced neck portions of the plurality of fastener elements in the portion to be gapped, and the moving step includes the moving of the comb relative to the tape with a pivotal movement.

5. A process as claimed in claim 4 wherein the gripping step includes the moving of a fastener element pull off member behind heel portions of the plurality of fastener elements in the portion to be gapped, and the moving step includes the moving of the pull off member simultaneous with the comb relative to the tape with a pivotal movement.

6. A process as claimed in claim 4 including the further step of stripping the removed fastener elements from the teeth of the comb.

7. A process of gapping a continuous slide fastener chain having a pair of tapes with interlocking fastener elements secured to inner edges of the tapes comprising the steps of advancing a selected length of the chain through a gapping station, separating the fastener elements and tapes as the chain is advanced into the gapping station, twisting the tapes to parallel positions in the gapping station, clamping the tapes of the chain on one side of the gapping station, clamping the separated tapes on the other side of the gapping station, holding the separated tapes and fastener elements on opposite sides of a portion of the chain to be gapped, inserting the teeth of a pair of combs between reduced neck portions of the fastener elements in the portion of the chain to be gapped, moving a pair of members above heel portions of the fastener elements in the portion of the chains to be gapped, pivoting the pair of combs and the pair of members such that the fastener elements in the portion of the chain to be gapped are each pulled seriatim from the respective tapes, advancing the separated stringer from the gapping station, and reinterconnecting the separated stringers.

* * * * *